US005513924A

United States Patent [19]

Alghunaim

[11] Patent Number: 5,513,924

[45] Date of Patent: May 7, 1996

[54] MOVEMENT RESISTANT RETROREFLECTIVE PAVEMENT MARKER

[75] Inventor: Mohammed S. Alghunaim, Dammam, Saudi Arabia

[73] Assignee: National Road Studs Company, Damman, Saudi Arabia

[21] Appl. No.: 251,585

[22] Filed: May 31, 1994

[51] Int. Cl.[6] ..... E01F 9/06

[52] U.S. Cl. ..... 404/14

[58] Field of Search ..... 404/12, 13, 14

[56] References Cited

U.S. PATENT DOCUMENTS

| | | | |
|---|---|---|---|
| 1,683,121 | 9/1928 | Baldwin | 404/13 |
| 1,928,447 | 9/1933 | Cornell, Jr. | 404/12 |
| 4,875,798 | 10/1989 | May | 404/14 X |
| 5,226,745 | 7/1993 | Gartlacher | 404/14 |
| 5,354,143 | 10/1994 | Lindner | 404/14 X |

FOREIGN PATENT DOCUMENTS

| | | | |
|---|---|---|---|
| 2692609 | 12/1993 | France | 404/13 |

*Primary Examiner*—William P. Neuder
*Attorney, Agent, or Firm*—Jones, Day, Reavis & Pogue

[57] ABSTRACT

A retroreflective pavement marker having shell-like hollow housing (with or without downwardly projecting ribs), downwardly projecting stud formed integrally as a unit with the housing, and thermoplastic retroreflectors having retroreflective elements visible through apertures in the housing. An epoxy based filler holds the reflector plate (or reflective plates) in place in the housing by solidly binding to the housing, stud and reflector plate (or reflective plates), adding impact resistance to the marker. The stud has outwardly extending vanes running along its longitudinal axis, creating an X-shaped cross-section. The vanes have outwardly facing flat surfaces and rounded surfaces therebetween. The marker is made by forming the housing (with or without ribs) and stud, placing the reflector plate (or reflective plates) in the housing, dispensing liquid fill material in the housing, and hardening the fill material.

27 Claims, 3 Drawing Sheets

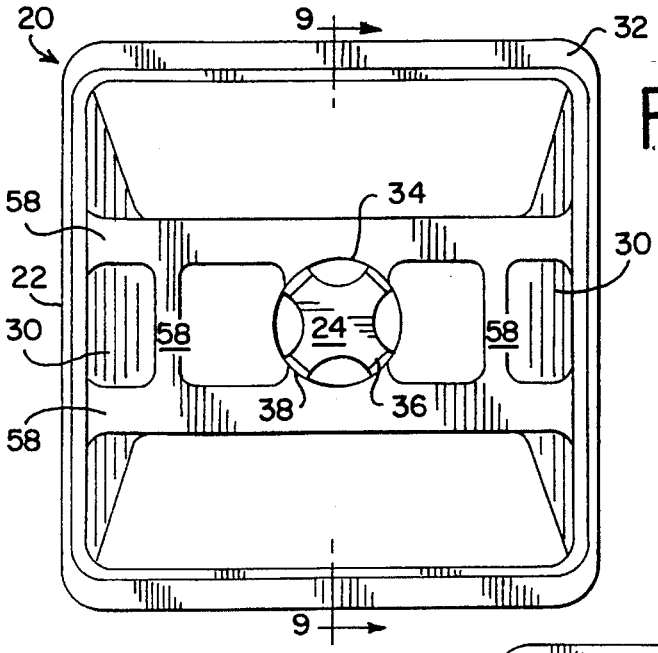
FIG. 7
FIG. 8
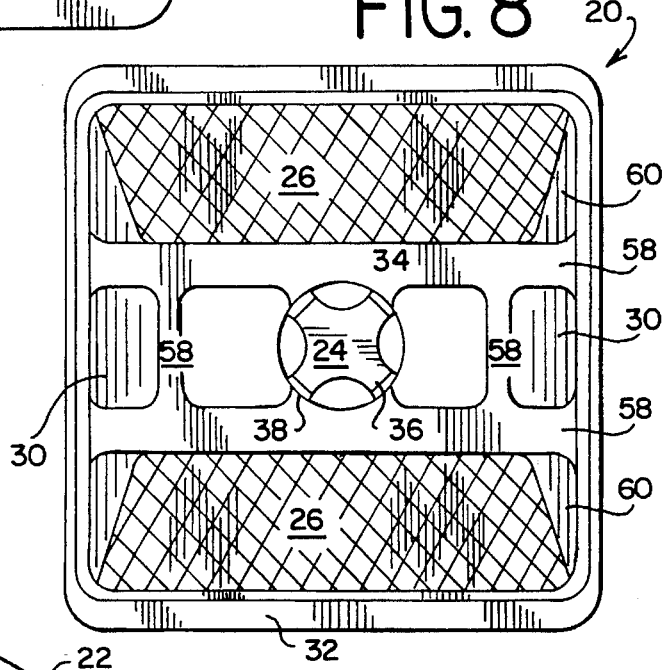
FIG. 9
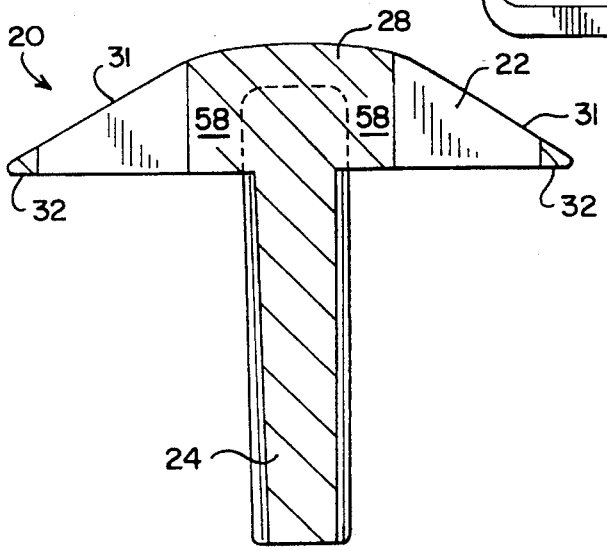

MOVEMENT RESISTANT RETROREFLECTIVE PAVEMENT MARKER

FIELD OF THE INVENTION

The invention relates generally to reflective road markers which are intended to be permanently mounted to a roadway surface. The invention more specifically relates to a permanently mountable roadway marker which is resistant to movement and damage when it is contacted by the tires of vehicles traveling at high speeds.

BACKGROUND OF THE INVENTION

Pavement markers have become widely accepted as permanent installations for providing visible signals which mark traffic lanes and control the flow of traffic on roadways in combination with, or in place of, conventional painted traffic lines. A large number of such markers employ retroreflectors which retroreflect light emanating from oncoming vehicles to provide a signal visible to the operators of such oncoming vehicles.

Reflective pavement markers are constructed with an outer shell of material and are designed to withstand high impact forces expected to be encountered on the highway. One of the earlier types of markers of the style generally still used today is shown in the Heenan U.S. Pat. No. 3,332,327. In the basic structure shown in the '327 patent, the plastic retroreflector elements are first formed as part of the walls of a hollow shell, and then a layer of metal, by vacuum metallization, is deposited on the exposed faces of the cube corner retroreflector elements. Following that step, the "shell" is filled or "potted" with a rigid epoxy-type material. The resulting structure is relatively rigid and over the years has proven to be remarkably durable in use.

The '327 patent and others in the past have flat bottoms which generally are secured to the road surface by adhesives. This method of attaching the marker to the road has been adequate in most "sun belt" areas where snow plows are not used. The marker will stay attached to the normal pavement surface found in the United States even when the asphaltic material to which the marker is attached is heated by the mid-summer sun and will not move laterally, rotate or sink into the pavement as a result of contact with vehicle tires.

In "snow belt" areas, pavement markers are subject to the potentially greater dislocating force of a snow plow blade. To avoid this impact, the markers are held in a metallic casting which is buried into the road surface. This casting has rails on either side of the retroreflector to lift the blade relatively harmlessly over the marker housing. While such castings successfully protect the markers from contact with snow plow blades, they add a substantial expense to the cost of each marker and its installation.

As the use of road markers has spread outside of the Western Hemisphere, new road and impact conditions are challenging the previously accepted means for permanently securing markers to the pavement surface and protecting them from damage. For example, in Saudi Arabia, vehicles generally have a significantly greater axle load, higher (or no) speed limits and tires with higher air pressure. In addition, the quality of the asphaltic material in the pavement is well below that found in the United States and other Western countries and subject to patches of softness.

Use of the type of marker shown in the '327 patent for the road conditions of the type described above has resulted in sinking of the marker into the pavement due to downward impact forces on the soft, sun heated pavement. Moreover, attachment of the marker to the road by use of butyl adhesives rather than epoxy, as required in that country, results in an undesirable lateral sliding and rotational movement of the marker.

Prior markers that contained shafts which were inserted into the pavement were only partially successful at preventing undesirable movement. U.S. Pat. No. 3,516,337 shows a traffic button or road marker with a shaft having triangular shaped projections. More recently, Stimsonite Corporation, offered its Model 325 road marker which has a torque resistant stud to keep the marker in place. Neither of these markers could withstand the punishment of the extreme road and traffic conditions presented in places such as Saudi Arabia.

It is an object of the present invention to provide an improved, impact resistant, retroreflective pavement marker which resists downward, lateral and rotational movement upon impact, even when it is installed on soft or other poor quality roads.

It is another object of the present invention to provide an improved, impact resistant, retroreflective pavement marker which resists movement caused by impacts with high velocity, high speed vehicles having high tire pressures, even when installed on soft or other poor quality roads.

It is yet a further object of the present invention to provide an improved, permanently installed, impact resistant, retroreflective pavement marker which resists movement as a result of impacts with high velocity, high speed vehicles having high tire pressures, but which is relatively inexpensive to manufacture and install.

Other and further objects of the invention are apparent from the following discussion of the invention and the preferred embodiment.

SUMMARY OF THE INVENTION

The present invention provides an improved, impact resistant, retroreflective pavement marker which resists downward, lateral and rotational movement when impacted by vehicles. The inventive marker is particularly useful in countries where the installed marker will be subject to impacts with heavier vehicles, traveling at higher speeds, with higher tire pressures than would normally occur in the United States. The present invention also is particularly useful for installation on poor quality roads of soft or crumbling asphaltic pavement. The invention does not require the purchase or installation of any additional structures to protect the marker, such as the casings used in association with "snow country" pavement markers.

The inventive pavement marker has a hollow housing formed of impact resistant aluminum, with top generally parallel to the surface of the roadway and side walls downwardly inclined from the top. A stud projects downward from the top of the housing and has a series of vanes running the length of the stud. The stud is formed from the same impact resistant material as the housing and is a unitary piece with the housing.

The housing contains a retroreflector plate flush against its inside surface. The retroreflector plate is a piece of thermoplastic material which has front and rear angled portions bearing retroreflective cube corner elements and an intermediate portion which contacts the inside of the top of the housing. The retroreflective cube corners are visible through the housing.

In an alternative marker embodiment, the hollow housing contains ribs projecting downward from the top of the housing until the ribs are substantially flush with the surface of the roadway. In this embodiment, the retroreflectors are independent from one another and are not connected to each other as part of a single plastic plate.

The housing is filled with a material that hardens in place to secure the retroreflector plate in the housing, supply additional tensile strength to the marker, and provide a flat bottom to contact the pavement surface. The fill material surrounds and is in contact with the portion of the stud which passes from the top of the housing downwardly through the center of the housing. The fill material, preferably an epoxy, binds to the stud, reflector plate and housing, increasing the security of the bond of the plate to the housing. The use of a fluid fill material that hardens with time allows for easy delivery of the material to the hollow interior of the housing and assures a flat surface to act as the bottom of the housing.

The present invention also contemplates a new and unobvious method for producing an improved retroreflective pavement marker. The method includes the steps of forming a unitary hollow housing and downwardly projecting stud from impact resistant aluminum, and placing a retroreflective thermoplastic plate to surround the stud at its intersection with the housing top and with reflector cube corners being visible through the forward and rearward faces of the housing. The reflector plate contacts the top of the housing and is secured in that position by the filling of the housing with epoxy. The epoxy either cures over time as a result of exposure to air and heat, or is permanently hardened by some other curing process.

The marker is installed with projecting stud inserted into the roadway, with bottom of the above-ground portion of the marker flat against the surface of the roadway. The stud is tapered to facilitate tight insertion into the ground and the shape of the stud vanes acts to prohibit rotational movement. Moreover, the stud prevents lateral movement of the marker as a result of sideways impact and inhibits downward movement into soft pavement as a result of pounding impacts. The aluminum housing-stud unit and epoxy fill combination adds tensile strength to the marker and decreases the likelihood that severe impacts will damage the marker.

BRIEF DESCRIPTION OF THE DRAWINGS

The present invention will be more fully understood in conjunction with the accompanying drawings in which like numbers indicate like components.

FIG. 7 is a bottom plan view of the hollow housing and unitary stud of an alternative embodiment of the retroreflective pavement marker invention.

FIG. 8 is a bottom plan view of the hollow housing and unitary stud of an alternative embodiment, now with thermoplastic reflector plates inserted herein.

FIG. 9 is a cross-sectional view of the hollow housing and unitary stud of an alternative embodiment taken at section line 9—9 in FIG. 7.

DETAILED DESCRIPTION OF THE PREFERRED EMBODIMENT

Figure 1:
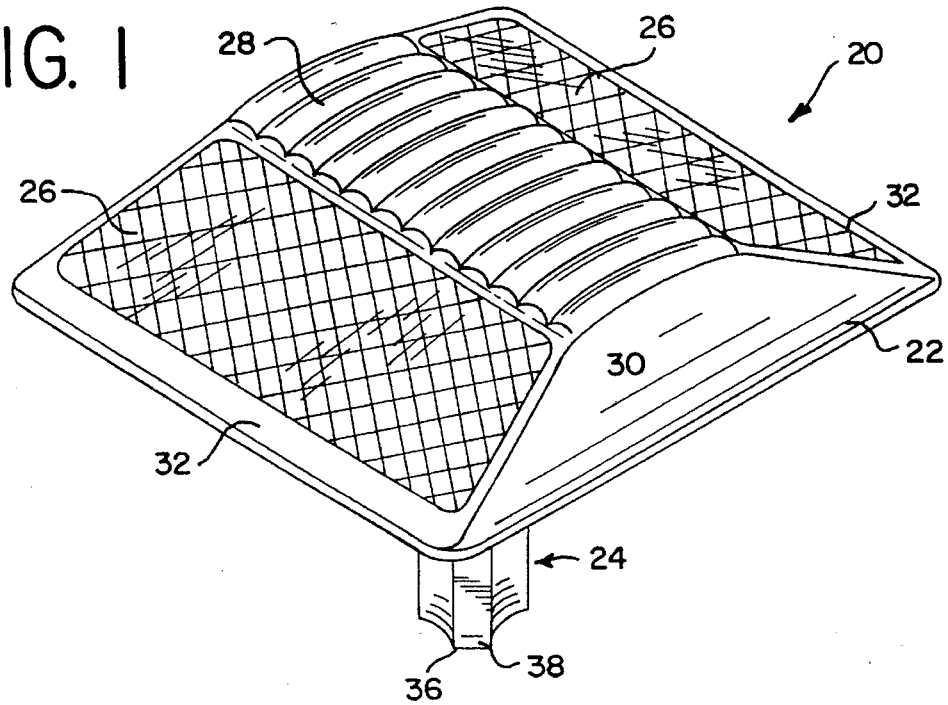
FIG. 1 is a top perspective view of the preferred embodiment of the retroreflective pavement marker invention.
Figure 2:
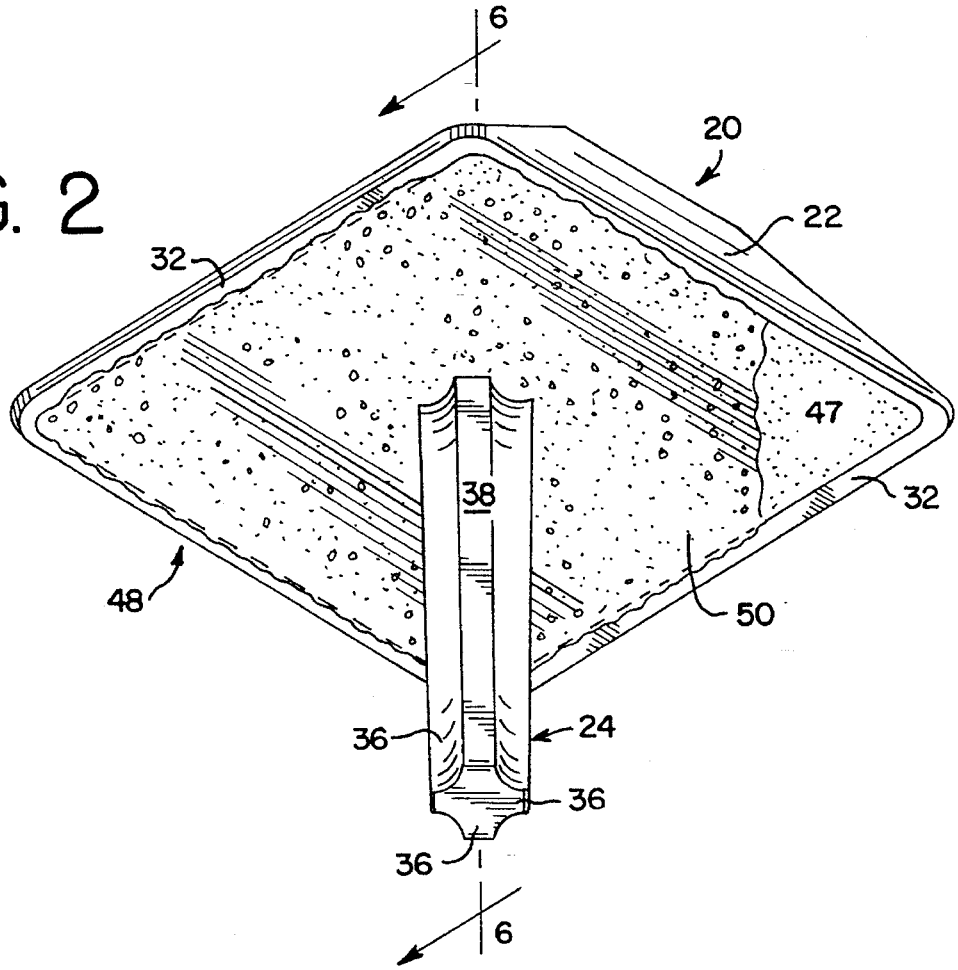
FIG. 2 is a bottom perspective view of the preferred embodiment of the retroreflective pavement marker invention.

With reference to FIGS. 1–6, the preferred embodiment of the pavement marker 20 of the present invention is comprised of a housing 22, downwardly projecting stud 24, and retroreflectors 26. The housing has top wall 28 generally flat and parallel to the surface of the roadway upon which the marker is to be mounted. Two side walls 30 are downwardly inclined from the top wall to define the sides of the housing while the front and rear faces of the housing contain openings 31 to allow the reflectors to be visible. The particular shape of the housing reduces the stress of impact of vehicle tires both for the tires and for the marker itself.

The housing also has lips 32 at its bottom that depart from the housing in forward and rearward directions. The lips will be flush against the pavement when the marker is installed in the roadway. The lips may be adhesively adhered to the pavement to supplement the primary method of permanently attaching the marker to the pavement by use of the stud.

The housing 22 and stud 24 are a single, unitary and integral piece formed of impact resistant aluminum. The stud projects downwardly (relative to the roadway when the marker is installed) from the center of the top wall 28 of the housing 22. The stud 24 and housing 22 intersect at a circular collar 34.

The stud 24 is tapered slightly as the stud projects away from the top wall and is shaped to define four vanes 36 that extend down the length of the stud and outwardly away from the stud. The presence of the vanes cause the stud to have an X-shaped cross-section. Each of the vanes has a flat outwardly directed face 38.

Figure 6:
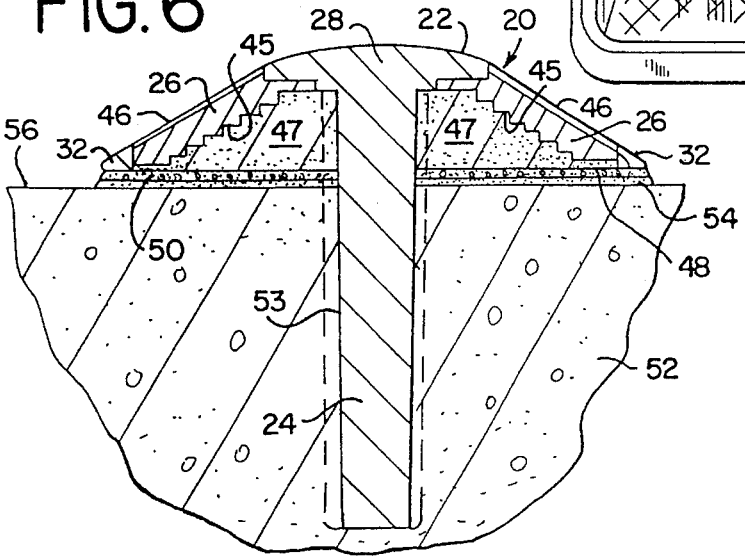
FIG. 6 is a cross-sectional view of the preferred embodiment installed in the roadway, taken through line 6—6 in FIG. 2.

The stud is curved between the vanes to define a smooth slide-like area that will facilitate insertion into the pavement. Because the stud is attached to the top of the housing, it passes through the interior of the housing before departing it. About one-fourth to one-fifth of the stud is contained within the interior of the housing, as shown in FIGS. 4 and 6.

Figure 4:
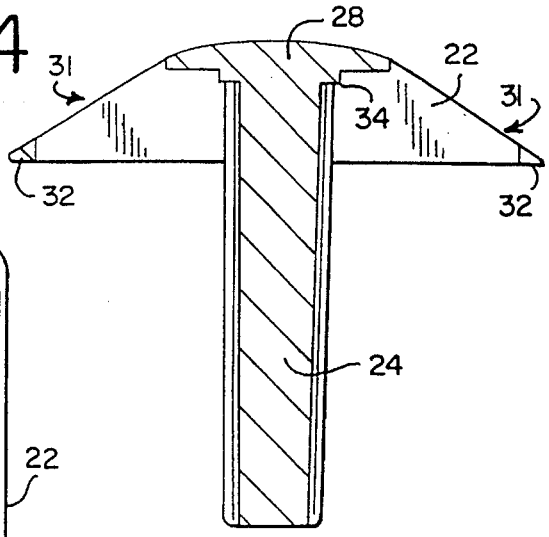
FIG. 4 is a cross-sectional view of the hollow housing and stud taken at section line 4—4 in FIG. 3.
Figure 3:
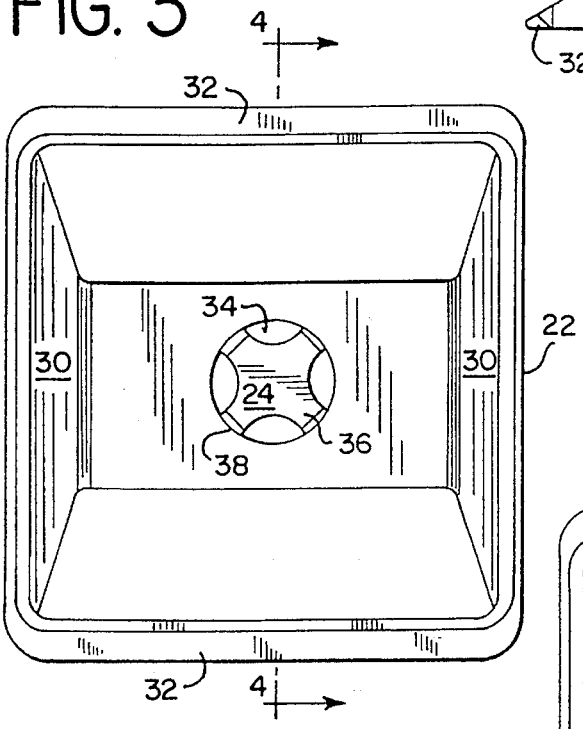
FIG. 3 is a bottom plan view of the hollow housing and unitary stud of the preferred embodiment.
Figure 5:
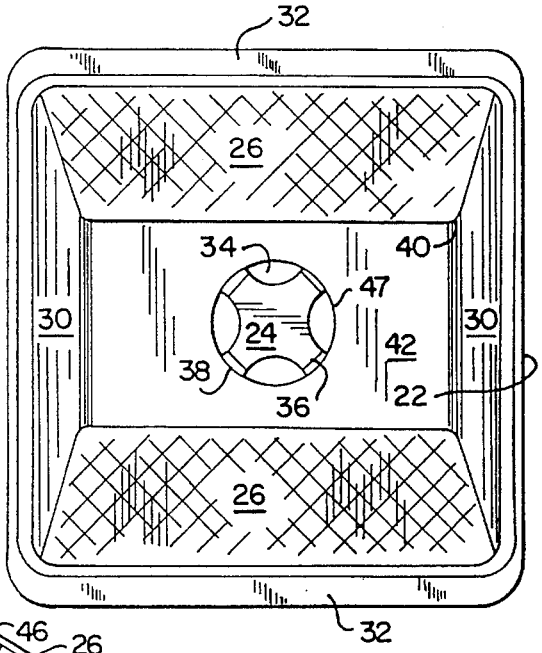
FIG. 5 is a bottom plan view of the hollow housing of the preferred embodiment, now with thermoplastic reflector plate inserted therein.

The unitary housing 22 and stud 24 are shown prior to assembly in FIGS. 3 and 4. FIG. 5 shows the housing and stud with the additional reflector plate 40 after it has been placed into, and in contact with, the housing 22, but before the introduction of the fill material. FIG. 6 shows a cross-sectional view of the preferred embodiment as installed in the roadway pavement, through section line 6—6 of FIG. 2.

The reflector plate 40 contains the reflector portions 26 and an intermediate flat portion 42. The forward and rear reflectors 26 are angled from the intermediate flat portion 42 of the reflector plate 40 so that they are flush against the edges of the housing openings 31 when the reflector plate 40 is placed into the housing 22 with intermediate portion in direct contact with the inside of the top wall 28.

The reflector plate 40 contains a round aperture 44 which snugly fits around the collar 34 where the stud intersects the housing top wall 28. The aperture 44 allows the reflector plate 40 to be slid down the length of the stud to its final assembly point in contact with the inside of the housing 22.

When residing in this position, the reflector plate 40 has its reflectors 26 visible through the openings 31 in the housing 22. Those portions of the reflector plate 40 contain cube corner reflector elements 45 on their inward side. The rear faces of those cube corners are reflectively coated as is known in the art. As a result, the retroreflectivity of the cube corners 45 is not lost when the filler in the housing contacts them.

The front faces of the reflector plate 40 that are visible through the housing openings 31 are susceptible to contact with vehicle tires and other objects which might mar the surface and damage the optical quality of the reflectors, lessening the optical quality. Accordingly, microthin sheets of untempered glass 46 may be adhered to the visible portions of the reflector plate 40. The use of glass sheets for this purpose is discussed in U.S. Pat. Nos. 4,232,979 and 4,340,319, incorporated by reference herein.

The marker contains a filler 47 which resides throughout the interior of the hollow housing in contact with the inside of the housing sidewalls 30, the reflector plate 40, and the portion of the stud 24 that is within the housing. The filler defines a flat portion in the same geometric plane as the bottom surface of the bottom lips 32 of the housing. As a result, the filler 47 and lips 32 create the bottom of the above-ground portion of the marker 20. The flat bottom may be adhesively bonded to the surface of the pavement and will assist in preventing the marker from being pushed into soft pavement or from cutting into the pavement as may occur when waffle bottom markers are used.

The housing and stud preferably are made from an aluminum of a thickness and grade which produces impact resistance; another metal or plastic material may be used as is known in the art to provide the appropriate strength. Impacts to the housing are transferred down the stud and distributed therethrough. Thus, the force of the impact not only is absorbed throughout the housing's connection to the pavement but along the stud's contact surface, including the flat faces 38 of the vanes, with the surrounding sub-surface pavement and ground.

Torque forces applied the housing by vehicular impacts are resisted by the stud construction. Vanes 36 prevent rotational movement by pushing against the surrounding pavement and ground along their sharp angular edges during an impact. The taper of the stud provides for ease of snug insertion into an undersized cylindrical hole and assists in the prevention of downward movement of the marker into soft pavement.

The reflector plate is formed of a thermoplastic material known in the art for the manufacture of cube corner retroreflectors. The application of a silvery, mirror surface to the rear surface of the cube corners also is generally known in the art.

The fill material is preferably an epoxy, but may be any other fill material known in the art. It preferably should be a hardenable fluid which can be poured or otherwise dispensed into the upside down housing. The epoxy or other material preferably will harden when exposed to air. Gravity will cause the surface of the epoxy to harden flat to create a bottom 48 surface. A layer of sand or beads 50 may be added to the flat surface 48 of the epoxy to provide a desirable bottom texture, as is known in the art.

The inventive marker is made by first forming the housing 22 and stud 24 from impact resistant material. Next the reflector plate 40 is slid down the stud and fit with aperture 44 snug around collar 34. The fill material is poured into the interior cavity of the upside down housing/stud piece until the top surface of the filler is even with the bottom lips 32 and the epoxy is hardened by contact with air, heat or some other method known in the art. Finally, sand is applied to the surface when the epoxy is partially hardened and is still tacky.

The marker is installed in the roadway 52 by first drilling a cylindrical hole 53 of a diameter slightly less than the average diameter of the stud. Next, the hole is blown clean and adhesive material 54 known in the art is inserted into the hole and around the surface 56 of the pavement where the bottom of the housing will contact it. Finally, the stud 24 of the marker is inserted into the hole and the marker forcibly pushed into its desired position in the road.

It has been found that although the design of the preferred embodiment typically provides adequate strength for small to medium sized markers, such as those having dimensions of 10 cm× 10 cm, additional structural support is needed for larger markers, such as those having dimensions of 15 cm×15 cm. The structure of an alternative embodiment, shown in FIGS. 7–9, provides this additional support. As in the preferred embodiment, the alternative embodiment is comprised of a housing 22, a downwardly projecting stud 24, and retroreflectors 26. However, in addition, a plurality of intersecting ribs 58 project downwardly (relative to the roadway when the marker is installed) from top wall 28 of housing 22 between the two side walls 30.

The ribs 58 extend to a plane even with the bottom lips 32, and therefore, will be substantially flush with the pavement when the marker is installed in the roadway. The housing 22, ribs 58 and stud 24 preferably are a single, unitary and integral piece formed of impact resistant aluminum. The stud 24 of this embodiment also has vanes 36 with flat faces 38.

FIG. 8 shows the housing, ribs and stud with reflective plates 60 placed inside housing 20 before the introduction of the fill material. Reflective plates 60 are angled so that they are flush against the edges of the housing openings 31 when the reflective plates 60 are placed into the housing 22. When the reflective plates 60 are placed in the housing, the retroreflectors 26 are visible through the openings 31 in the housing 22. Unlike the preferred embodiment, the retroreflectors 26 in this alternative embodiment are not molded as part of a single thermoplastic piece surrounding the stud.

The marker contains a filler 47 which resides throughout the interior of the hollow housing in contact with the inside of the housing sidewalls 30, the ribs 58, the reflective plates 60, and the portion of the stud 24 that is within the housing. The filler acts to hold the various parts of the marker together and defines a flat portion in the same geometric plane as the bottom surface of the bottom lips 32 of the housing.

The alternative embodiment of this inventive marker is made by first forming the housing 22, ribs 58 and stud 24 from impact resistant material. Next the reflective plates 60 are placed in the housing 22 so that the retroreflectors 26 are visible through openings 31 in the housing 22. The fill material is poured into the interior cavity of the upside down housing/ribs/stud piece until the top surface of the filler is even with the bottom lips 32 and ribs 58. The fill material 47 is hardened by contact with air, heat or some other method known in the art. Finally, sand 50 is applied to the flat surface 48 when the fill material is partially hardened and is still tacky. This marker embodiment is installed in the roadway 52 by the same method as the preferred embodiment of this inventive marker.

While there has been described what is at present believed to be the preferred embodiment and an alternative embodiment of the invention, it will be understood that various modifications may be made therein without departing from the scope of the invention which is intended to be and is defined by the claims appearing below.

I claim:

1. A retroreflective pavement marker comprising:

a hollow housing formed of an impact resistant material, the housing having a top wall generally parallel to the surface of the roadway and a plurality of side walls downwardly inclined from the top wall, the housing having a forward face which is substantially open;

a stud projecting downwardly perpendicular from the interior of the top wall of the housing at a generally central location relative to the housing, the stud being formed of the same impact resistant material as the housing and being formed unitarily with the housing;

reflector means formed of thermoplastic material, the reflector means having a first portion containing retroreflective cube corner elements on its rearward side, the reflector means being downwardly inclined at the forward face of the housing with the retroreflective cube corners being visible through the forward face; and, fill means in and filling the inside of the housing and substantially anchoring the reflector means to the housing.

2. The retroreflective pavement marker of claim 1, wherein the housing and the stud are formed of aluminum.

3. The retroreflective pavement marker of claim 1, wherein the stud has a plurality of vanes extending the length of the stud, the vanes projecting outwardly from the stud.

4. The retroreflective pavement marker of claim 3, wherein the stud has four vanes arranged to define an X-shaped cross-section.

5. The retroreflective pavement marker of claim 4, wherein the stud is tapered along its length.

6. The retroreflective pavement marker of claim 5, wherein the vanes have flat outward faces.

7. The retroreflective pavement marker of claim 1, wherein the first portion of the reflector means is covered by a sheet of micro-thin untempered glass.

8. The retroreflective pavement marker of claim 1, wherein the housing is substantially open at its rearward face and wherein the reflector means includes a second portion containing retroreflective cube corner elements, the reflector means being downwardly inclined at the rearward face of the housing with the retroreflective cube corners being visible through the rearward face.

9. The retroreflective pavement marker of claim 8, wherein said reflector means has a third portion contacting the inside surface of the housing, said third portion being integral with said first portion and said second portion of said reflector means.

10. The retroreflective pavement marker of claim 9, wherein the third portion of the reflector means substantially surrounds the stud near its junction with the top wall of the housing.

11. The retroreflective pavement marker of claim 7, wherein the second portion of the reflector means contacts a substantial portion of the inside surface of the top wall.

12. The retroreflective pavement marker of claim 1, wherein the fill means is epoxy.

13. The retroreflective pavement marker of claim 1, further comprising rib means extending downward from the top wall of the housing to add structural support to the housing.

14. The retroreflective pavement marker of claim 13, wherein the rib means comprise two parallel ribs which bisect the housing.

15. The retroreflective pavement marker of claim 14, wherein the rib means further comprises at least one connecting rib between the parallel ribs and oriented perpendicular thereto.

16. The retroreflective pavement marker of claim 13, wherein the stud has a plurality of vanes extending the length of the stud, the vanes projecting outwardly from the stud.

17. The retroreflective pavement marker of claim 16, wherein the stud has four vanes arranged to define an X-shaped cross-section.

18. The retroreflective pavement marker of claim 17, wherein the stud is tapered along its length.

19. The retroreflective pavement marker of claim 17, wherein the vanes have flat outward faces.

20. The retroreflective pavement marker of claim 13, wherein the first portion of the reflector means is covered by a sheet of micro-thin untempered glass.

21. A retroreflective pavement marker comprising:

a hollow housing formed from aluminum, the housing having a top wall generally parallel to the surface of the roadway and side walls downwardly inclined from the top wall, the housing being substantially open at its forward and rearward faces;

a stud projecting downwardly perpendicular from the top wall of the housing, the stud being formed from aluminum and being formed unitary with the housing, the stud having a plurality of vanes extending the length of the stud, the vanes projecting outwardly from the stud;

reflector means formed of thermoplastic material, the reflector means having a first portion containing retroreflective cube corner elements, a second portion substantially surrounding the stud near its junction with the top wall of the housing and contacting the inside surface of the housing, the first portion of the reflector means being downwardly inclined at the forward face of the housing with the retroreflective cube corners being visible through the forward face of the housing, and a third portion containing retroreflective cube corner elements, the third portion of the reflector means being downwardly inclined at the rearward face of the housing with the retroreflective cube corners being visible through the rearward face of the housing; and, fill means in and filling the inside of the housing and substantially anchoring the reflector means to the housing.

22. A retroreflective pavement marker comprising:

a hollow housing formed from aluminum, the housing having a top wall generally parallel to the surface of the roadway and side walls downwardly inclined from the top wall, the housing being substantially open at its forward face;

a stud projecting downwardly perpendicular from the top wall of the housing, the stud being formed from aluminum and being formed unitary with the housing, the stud having four vanes extending the length of the stud, the vanes projecting outwardly from the stud to define an X-shaped cross-section, the vanes also having flat outward faces;

reflector means formed of thermoplastic material, the reflector means having a first portion containing retroreflective cube corner elements on its rearward side and a second portion substantially surrounding the stud near its junction with the top wall of the housing and contacting the inside surface of the housing, the reflector means being downwardly inclined at the forward face of the housing the retroreflective cube corners being visible through the forward face; and, fill means in and filling the inside of the housing and substantially anchoring the reflector means to the housing.

23. A method of making a retroreflective pavement marker, the method comprising:

forming a hollow housing from impact resistant aluminum, the housing having a top wall generally parallel to the surface of the pavement and side walls downwardly inclined from the top wall, the housing being substantially open at its forward face, the housing having a stud projecting downwardly perpendicular from the top wall of the housing, the stud being formed of the same impact resistant aluminum as the housing and being formed unitary with the housing;

placing a reflector means formed of thermoplastic material into the housing, the reflector means having a first portion containing retroreflective cube corner elements on its rearward side, the reflector means placed with the first portion being inclined at the forward face of the housing and with the retroreflective cube corners being visible through the forward face of the housing;

filling the housing with epoxy which hardens upon curing; and, curing the epoxy.

24. The method of making a retroreflective pavement marker of claim 23, wherein the housing is substantially open at its rearward face and wherein the reflective means includes a second portion containing retroreflective cube corner elements on its rearward side, the reflector means being downwardly inclined at the rearward face of the housing with the retroreflective cube corners being visible through the rearward face.

25. The method of making a retroreflective pavement marker of claim 24, wherein said reflector means has a third portion contacting the inside surface of the housing, said third portion being integral with said first portion and said second portion of said reflector means.

26. The method of making a retroreflective pavement marker of claim 23, wherein the stud has four laterally extending vanes along its length, the vanes being oriented with respect to one another to form an X-shaped cross-section.

27. A method of making a retroreflective pavement marker, the method comprising:

forming a hollow housing from impact resistant aluminum, the housing having a top wall generally parallel to the surface of the roadway and side walls downwardly inclined from the top wall, the housing having at least one support rib between the side walls, the housing being substantially open at its forward face, the housing having a stud projecting downwardly perpendicular from the top wall of the housing, the stud being formed of the same impact resistant aluminum as the housing and being formed unitary with the housing;

placing a reflector means formed of thermoplastic material in the housing, the reflector means having a first portion containing retroreflective cube corner elements on its rearward side, the reflector means placed with the first portion being inclined at the forward face of the housing and with the retroreflective cube corners being visible through the forward face of the housing;

filling the housing with epoxy which hardens upon curing; and, curing the epoxy.

* * * * *